US008166618B2

(12) United States Patent
Eriksson

(10) Patent No.: US 8,166,618 B2
(45) Date of Patent: May 1, 2012

(54) STRAPS AND METHOD OF USING STRAPS FOR HOLDING SINKS IN POSITION

(76) Inventor: Leonard Eriksson, Oxnard, CA (US)

( * ) Notice: Subject to any disclaimer, the term of this patent is extended or adjusted under 35 U.S.C. 154(b) by 781 days.

(21) Appl. No.: 12/260,954

(22) Filed: Oct. 29, 2008

(65) Prior Publication Data

US 2009/0108143 A1 Apr. 30, 2009

Related U.S. Application Data

(63) Continuation-in-part of application No. 11/978,865, filed on Oct. 29, 2007.

(51) Int. Cl.
*E03C 1/33* (2006.01)

(52) U.S. Cl. ..... 24/302; 4/631

(58) Field of Classification Search ..... 24/298, 24/302; 4/643, 645, 647–649, 631–636; 248/27.1, 318

See application file for complete search history.

(56) References Cited

U.S. PATENT DOCUMENTS 5,842,240 A * 12/1998 Kato et al. ..... 4/633
5,903,936 A * 5/1999 Kato ..... 4/633
5,911,521 A * 6/1999 Steinmetz et al. ..... 4/633

* cited by examiner

*Primary Examiner* — James Brittain

(57) ABSTRACT

A strapping device used for installing, supporting, and sealing under-mount sinks comprises a series of straps looped by a series of rings and locking tightening devices. The locking tightening devices are used to tighten the straps and raise and support an under-mount sink in position. The rings and straps are anchored to hooks attached to the edge of the sink opening on the counter top underlay. A series of hooks are capable of holding a series of straps under tension to support an under mount sink in position with a located on the lip of the under-mount sink. A continuous loop of closed cell PVC is disposed atop the lip of the sink, so that when the sink is tightened through the countertop underlay, the lip of the sink encounters the underside of the countertop and the sealing material is compressed, forming a permanent, flexible, water-tight seal.

17 Claims, 9 Drawing Sheets

STRAPS AND METHOD OF USING STRAPS FOR HOLDING SINKS IN POSITION

CROSS-REFERENCE TO RELATED APPLICATION

Not Applicable

This application is a continuation-in-part of patent application Ser. No. 11/978,865, filed on Oct. 29, 2007.

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

Kitchen and bathroom sinks are known in the art, as are methods for mounting them under countertops. The present invention relates to straps and more particularly, to straps used to hold and install under-mount sinks in place. When installing under-mount sinks, there is a critical need to provide a means of not only supporting the under-mount sink securely, but to also provide a means of interchanging it after installation.

Currently, various mechanisms and devices are used to support sinks during the installation process. A common method uses a wood frame connected from underneath the counter underlay leading into the sink opening where the under-mount sink is to be installed. Wood members are cut to fit the under-mount sink area corresponding to under-mount sink variations. This is a tedious and time consuming process.

Other methods used to support an under-mount sink include insetting the sink to a sheet of plywood that has been attached securely to the cabinet or a metal sink frame manufactured to fit a particular hole size in the countertop. The metal frame is normally in the shape of a rectangular ring. It has a top, which rests on the counter, and a provision for the sink to be held by lugs attached to the frame.

For example U.S. Pat. No. 5,538,206 to Sathers discloses sink supports consisting of a cross member with a mounting bracket on each end. The brackets are designed to rest on the top edge of the vertical element supporting the countertop. Adjustment screws are provided in the cross member for aligning the sink with the countertop.

Therefore, it is the objective of the present invention to address the need for a convenient strapping device that tightens and supports under-mount sinks against the underside of the countertop, and which enables a user to effortlessly install and remove an under-mount sink when necessary.

SUMMARY

The present invention relates to straps and more particularly to straps used to hold sinks in place during and after a countertop installation, and the method for installation thereof. The invention consists of a strapping device comprising a ratcheting mechanism disposed on the strap. The strap is looped through the window disposed on a hook, that anchors to the edges of the sink opening on the countertop underlay. When the sink is installed in the sink opening, shortening the straps with the ratcheting mechanism rises the sink to ensure the lip of the under-mount sink creates a leak proof junction with the underside of the countertop, by employing a sealing material of closed cell PVC between the top of the lip of the sink and the underside of the counter.

The present invention also relates to a strapping device for smaller, bathroom style bowl-shaped sinks characterized by a series of straps that comprise an interlocking basket for supporting under-mount sinks.

DETAILED DESCRIPTION

The present invention consists of a device for sealing an under-mount sink as shown and described wherein at least one hook is disposed between a counter underlay and countertop at the junction of the underlay and countertop sink opening. The present invention also consists of at least one strap attached to the at least one hook, wherein the hook is capable of holding the strap under tension including a means for shortening the length of the strap. The present invention additionally consists of a method of installation, wherein a sealing material is disposed on the lip of an under-mount sink, wherein when the under-mount sink is placed on at least one strap, and the at least one strap is shortened, the sink is elevated against the underside of the countertop compressing the sealing material between the lip of the sink and the underside of the countertop.

Figure 1:
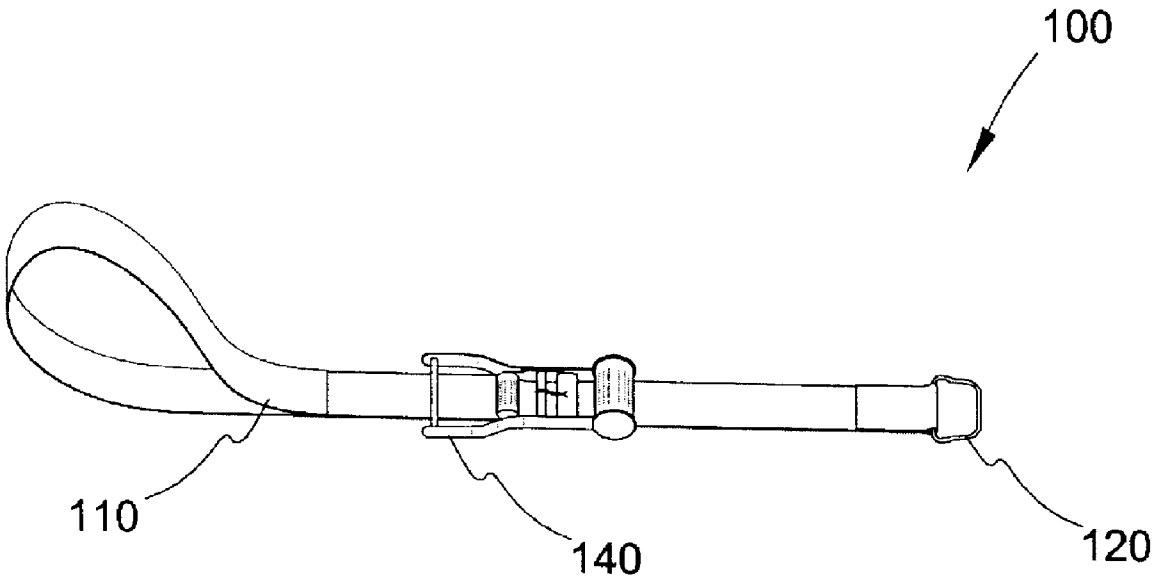
FIG. 1 is a perspective view of a strap comprising a ratcheting mechanism.

Referring to FIG. 1, the present invention comprises a strapping device for sealing an under-mount sink. The strapping device comprises a strap 100, a ring 120 anchored to the strap 100 wherein the ring is connected to the strap 100 by having the strap loop through the ring 120. In one preferred embodiment, the strap 100 comprises a locking shortening means for shortening the length of the strap, and locking it into a shortened position. In a further preferred embodiment, the shortening means comprises a ratcheting mechanism device 140 disposed thereon.

Figure 2:
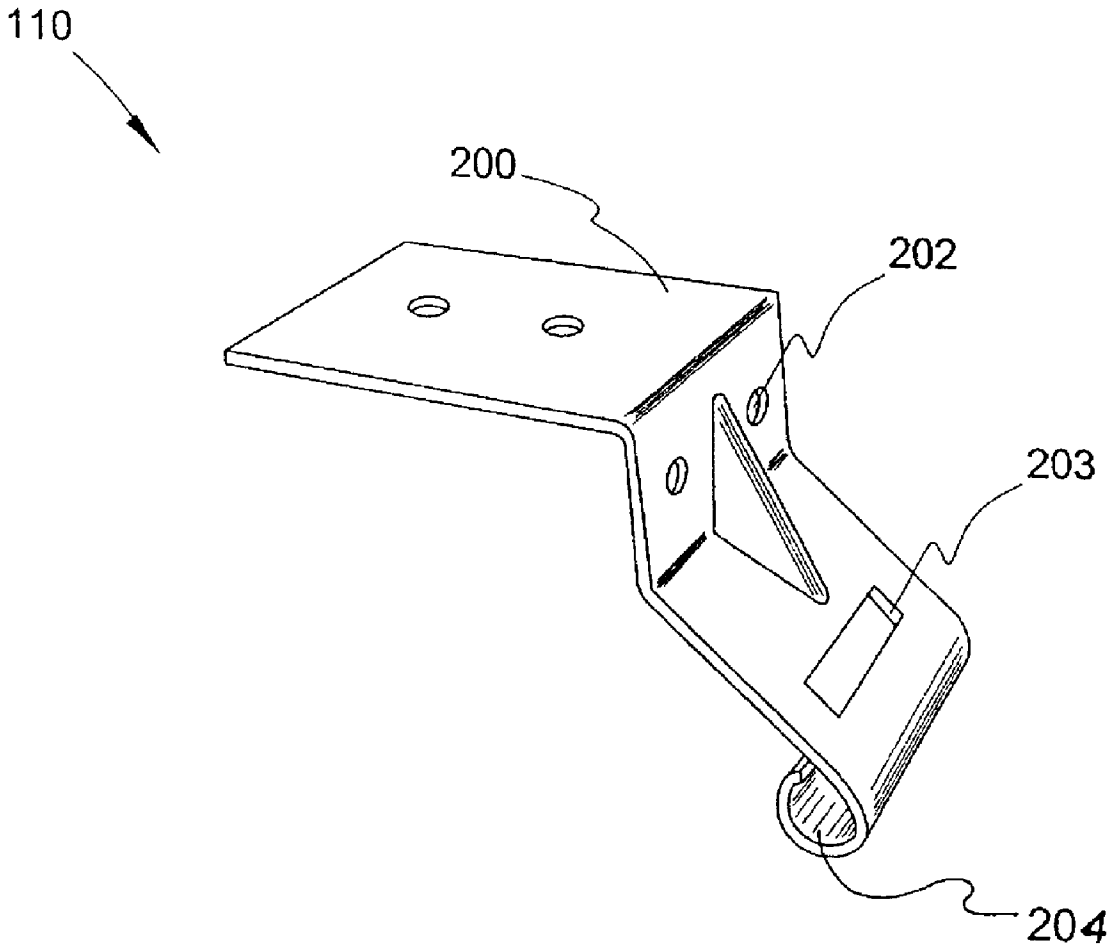
FIG. 2 is a perspective view of the hook.

Referring to FIG. 2, a perspective view of the means 110 for anchoring is shown, wherein a preferred embodiment, the anchoring means 110 comprise at least one hook 200 consisting of a window 203 for looping the strap 100 (shown in FIG.

3) and a series of holes 202 for anchoring, and a curled edge 204 for attaching the ring 120.

Figure 3:
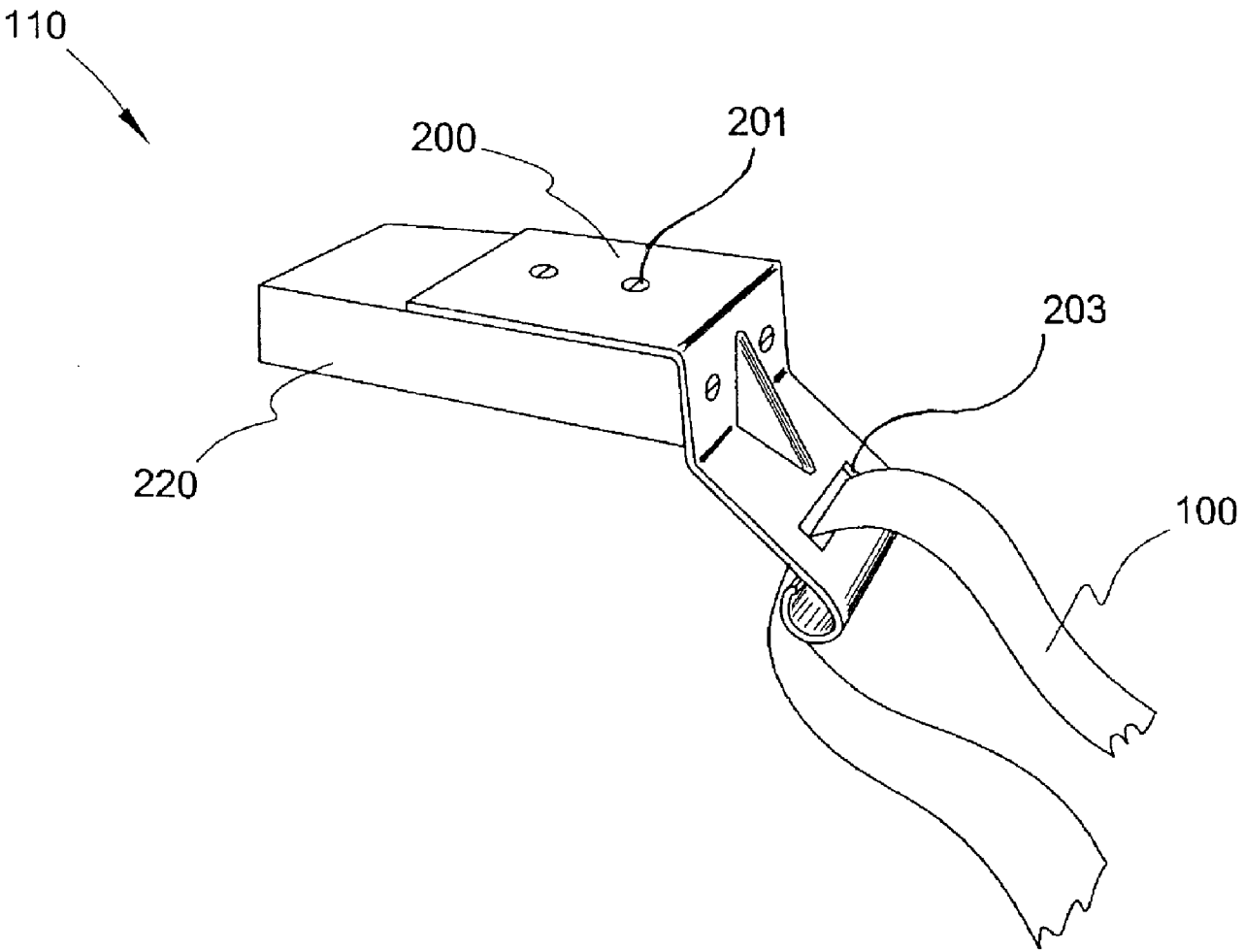
FIG. 3 is a perspective view of the hook anchored to the strap.

Referring to FIG. 3, the strapping device further comprises a means 110 for anchoring the strap 100 in position. In a preferred embodiment, the anchoring means 110 comprises at least one hook 200 looped with the strap 100 through the window 203 portion disposed on the hook 200. The anchoring means 110 holds the strap under tension while the shortening means 140 (as shown in FIG. 1) tightens the strap 100 against a sink. In one preferred embodiment, the anchoring means 110 comprises at least one hook 200, further comprising a metal bracket to rigidly brace objects held by the strap 100.

Still referring to FIG. 3, the hook 200 comprises a substantially 90 degree angled member anchored at the top and walls of the opening of the counter underlay 220. The anchoring means 110 comprising the hook 200 is rigidly fixed to a counter underlay 220 by one or more fasteners 201.

Figure 4:
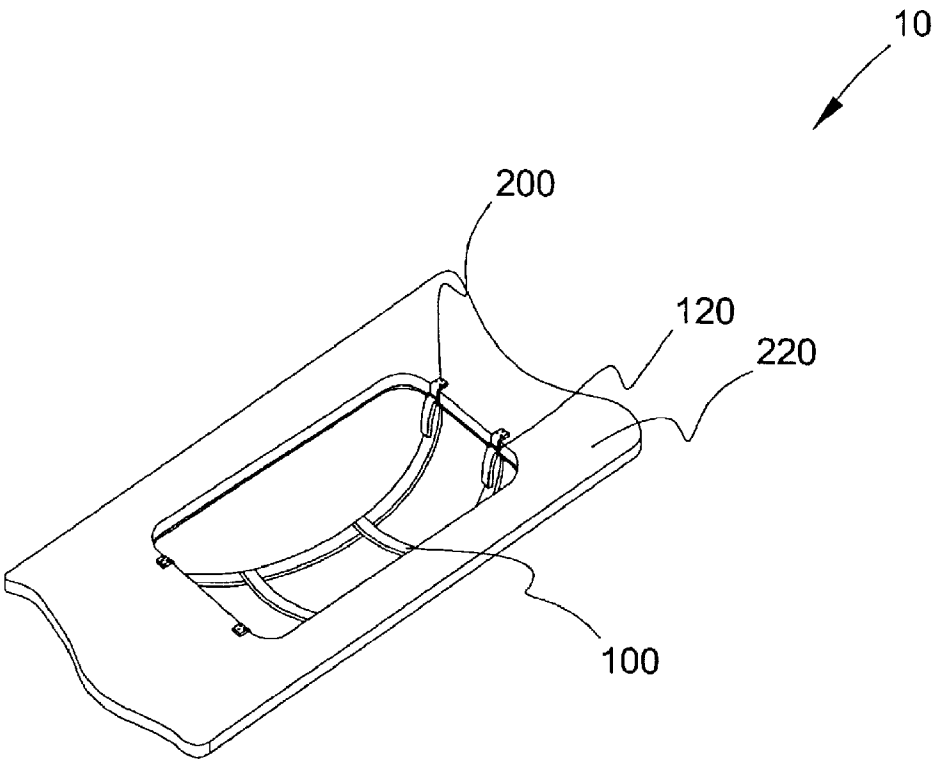
FIG. 4 is a perspective view above the sink opening with the strapping device installed.

Referring to FIG. 4, a perspective top view of the sink strapping device 10 comprising multiple rings 120 including multiple hooks 200 and multiple straps 100, to anchor and seal an under-mount sink in position. This configuration of the strapping devices 10 discloses a series of two parallel straps disposed orthogonally with another series of two adjustable parallel straps to evenly distribute the pressure of the lip of the sink against the bottom of the countertop. In a preferred method for leak-proofing a sink, a first step comprises fixing hooks 200 at the junction of a counter underlay 220 and countertop sink opening. The hooks 200 are disposed between the countertop underlay 220 and countertop (not shown) without increasing the distance between the countertop underlay 220 and countertop.

Figure 5:
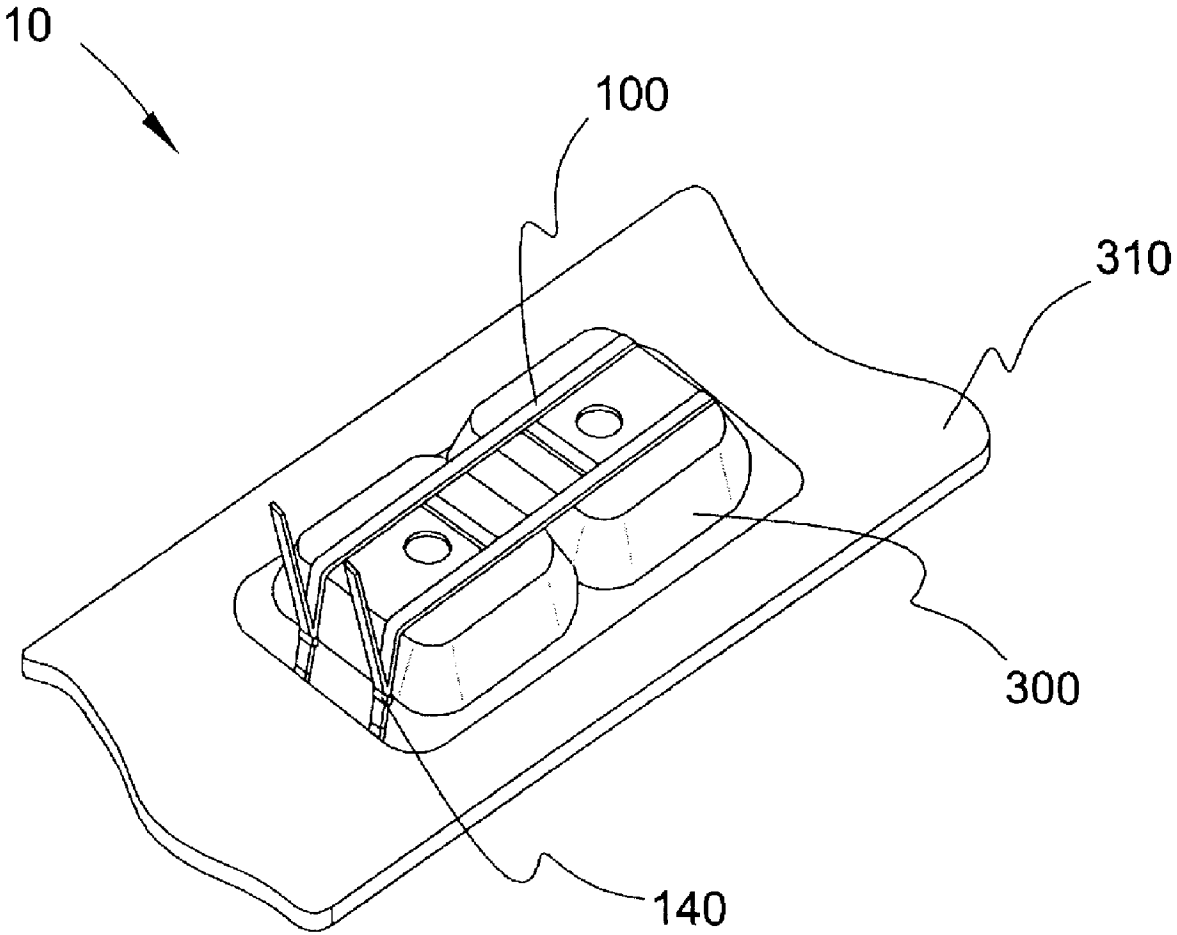
FIG. 5 is a perspective view underneath the sink opening with the strapping device and sink installed.

Referring to FIG. 5, a strapping device 10 is shown disposed under an under-mount sink 300. Two straps 110 are disposed parallel lengthwise under the sink, and two adjustable straps 110 are disposed substantially perpendicular to the lengthwise straps 110. In a preferred method of for leak-proofing a sink, a sealing material (not shown) is disposed atop the lip of the under-mount sink 300, wherein when the under-mount sink 300 is placed on the straps 100, and the straps 100 are shortened by the shortening means 140, the under-mount sink 300 is elevated through the countertop underlay 310 compressing the sealing material between the lip of the under-mount sink 300 and the countertop. The sealing material comprises a continuous loop, and in a preferred embodiment, is comprised of closed cell PVC that compresses to ⅛ inch when installed.

Figure 6:
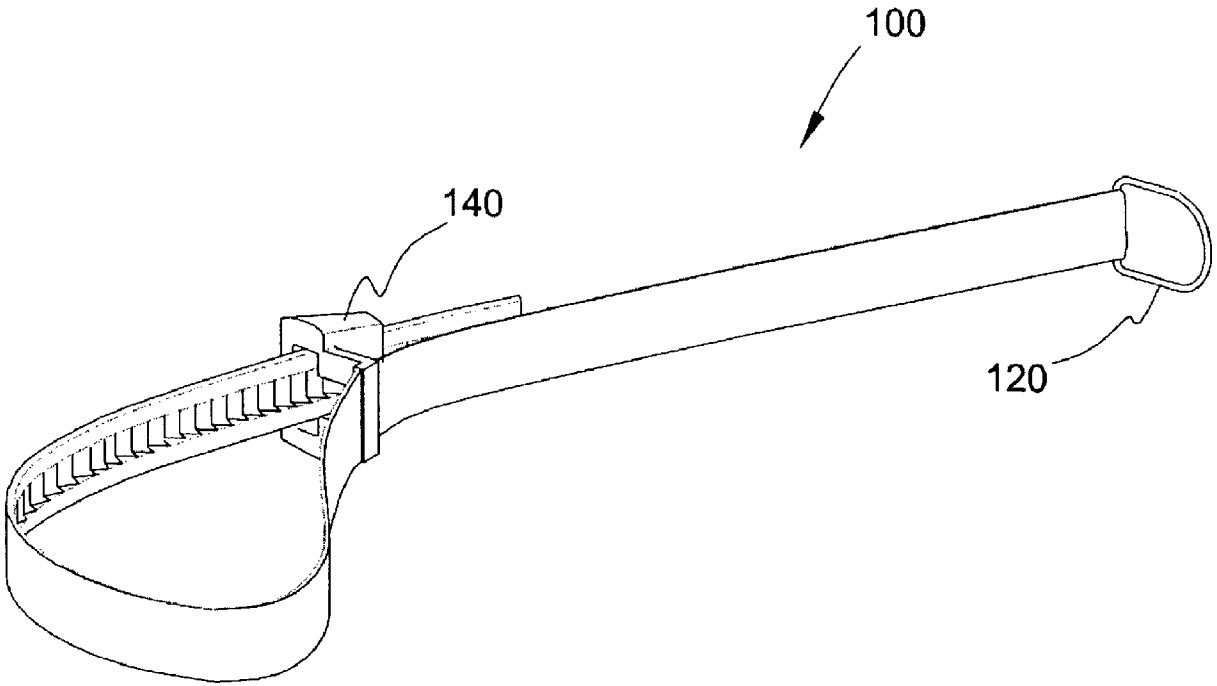
FIG. 6 is a perspective view of a strap with an integrated toothed-track and a clutch locking device.

Referring to FIG. 6, an alternate embodiment of the strap 100 is shown, including a ring 120 and a strap shortening means 140 comprising an integrated toothed-track with a clutch locking device.

Figure 7:
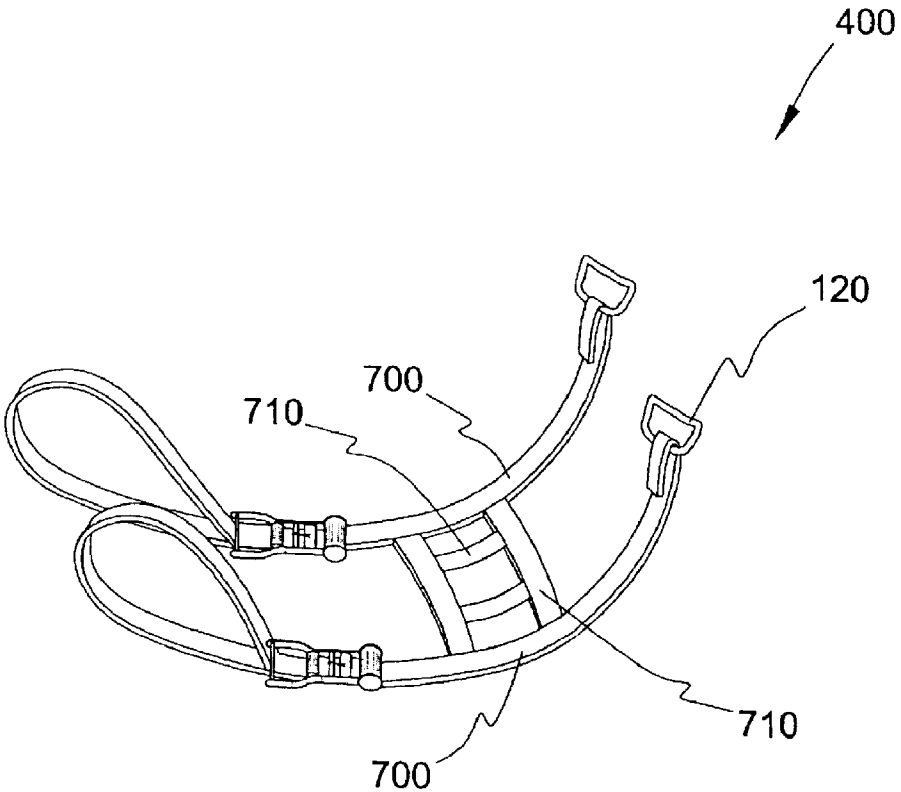
FIG. 7 is a perspective view of several straps comprising a basket.

Referring to FIG. 7, an alternate embodiment of the system is shown for use with smaller, bowl-shaped, bathroom style sinks. In this embodiment, the device comprises a basket 400 of straps. In one preferred example of this embodiment, the basket 400 comprises a first series of interconnected straps 710, which are secured to each other to further comprise a basket, through which the base of a sink can be disposed. A second series of straps 700 are equipped with rings 120, which connect to hooks (Shown in FIG. 9) at the edge of a countertop underlay 220.

Figure 8:
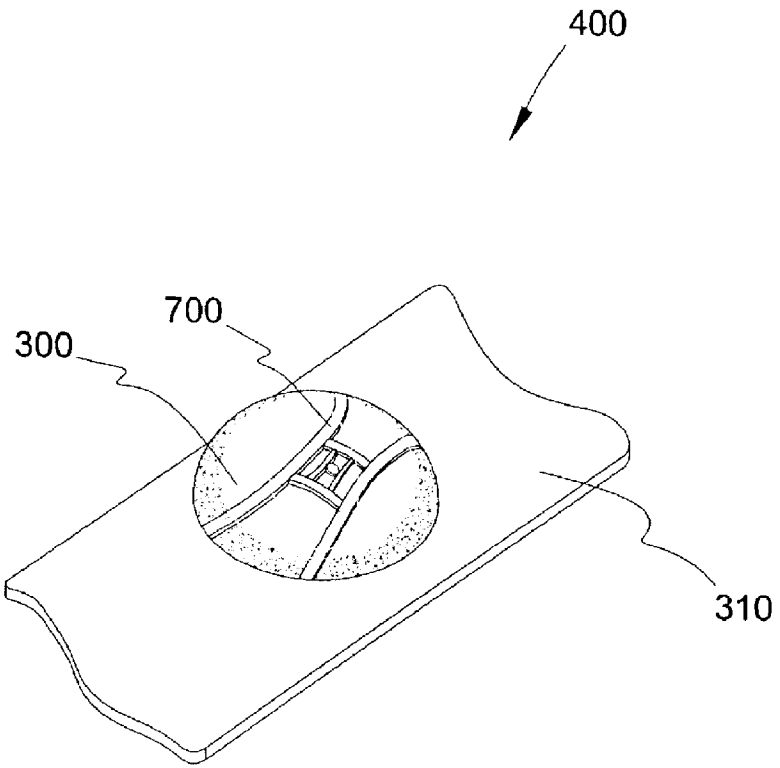
FIG. 8 is a perspective view underneath a bathroom style sink installed with basket straps.

Referring to FIG. 8, the drawing shows a perspective view of the countertop underlay 310 and the under-mount sink 300 installed with the strap basket 400. In a preferred installation method, positioning adjustments to the second series of straps 700 are made to avoid plumbing fixtures after installation of the strap basket 400. In a further preferred embodiment, the drain of the sink is disposed through an opening at the bottom of the basket 400.

Figure 9:
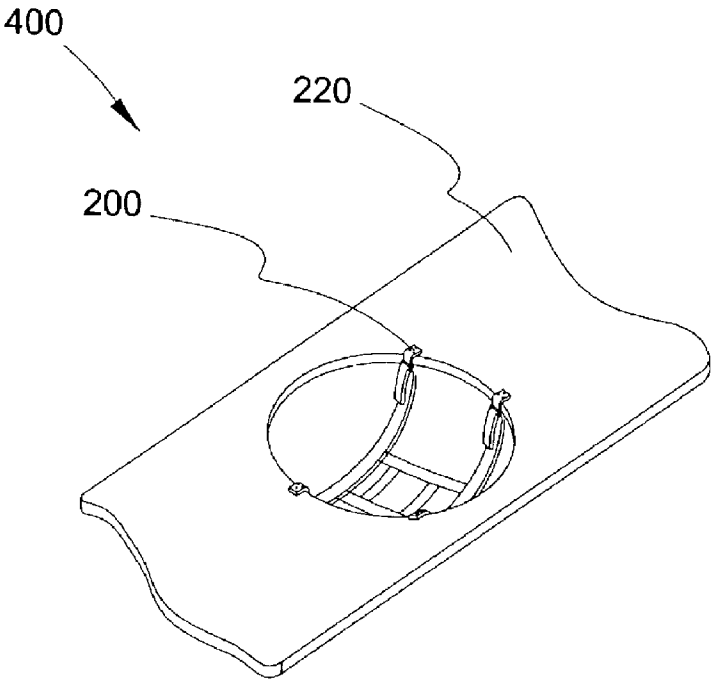
FIG. 9 is a perspective view above a bathroom style sink opening with basket straps.

Referring to FIG. 9, one preferred embodiment of the strap basket 400 comprises hooks 200 disposed at least six inches from the face of a cabinet, and at least six inches from the back of the cabinet. Upon installation of the strap device 400, a sealing material (not shown) is disposed around the lip of the under-mount sink 300 (not shown) comprising a continuous loop. In a preferred embodiment the sealing material is comprised of closed cell PVC that compresses to ⅛ inch when installed.

The method of leak-proofing a sink using the strapping device comprises the steps of: first, placing hooks at the junction of a countertop underlay and countertop sink opening; second, attaching straps between the hooks, so that the straps are capable of supporting an under-mount sink; third, placing the under-mount sink on the straps, and placing a water sealing material along the top lip of the under-mount sink; fourth, installing a countertop over the countertop underlay and under-mount sink; fifth, adjusting the straps to tighten them, thereby raising the under-mount sink against the countertop underside, compressing the sealing material.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A device for sealing an under-mount sink, characterized by:

a. at least four anchoring hooks disposed between a counter underlay and countertop at the junction of the underlay and countertop sink opening;

b. at least two straps anchored to the four hooks, wherein the hooks are capable of holding the straps under tension;

c. a means for shortening the length of each strap;

d. a sealing material disposed on the lip of an under-mount sink, wherein when the under-mount sink is placed on the straps, and the straps are shortened, the sink is elevated against the underside of the countertop compressing the sealing material between the lip of the sink and the underside of the countertop.

2. The device of claim 1, wherein the means for shortening the length of the straps comprises a ratcheting mechanism.

3. The device of claim 1, wherein the hooks are anchored to the straps a using window portion of the hooks and looped with the straps.

4. The device of claim 3, wherein the hooks are comprised of a metal bracket to rigidly brace objects by the straps.

5. The device of claim 1, wherein multiple hooks and straps are used to anchor and seal an under-mount sink in position.

6. The device of claim 5, wherein two straps are disposed lengthwise under an under-mount sink and two additional straps are substantially perpendicular disposed on the lengthwise straps to further comprise an adjustable basket.

7. The device of claim 1, wherein the straps comprise an integrated toothed-track with a clutch locking device disposed thereon.

8. The device of claim 1, wherein the hooks are disposed between the underlay and countertop without increasing the distance between the underlay and countertop.

9. The device of claim 1, wherein the straps comprise a first series of straps interconnected to further comprise a basket through the base of which the drain of the sink can be disposed, and a second series of straps that connect to hooks at the edge of a sink.

10. The device of claim 9, wherein the first series of straps are fastened in position relative to each other, and the second series of straps are adjustable.

11. The device of claim 1, wherein the hooks are disposed at least six inches from the face of a cabinet, and at least six inches from the back of the cabinet.

12. The device of claim 1, wherein the sealing material comprises a continuous loop around the lip of the sink.

13. The device of claim 1, wherein the sealing material is comprised of a closed cell PVC sealing material that compresses to ⅛ inch when installed.

14. A method of leak-proofing a sink, comprising the steps of:

a. placing at least four anchoring hooks at the junction of a counter underlay and countertop sink opening;

b. attaching at least two adjustable straps between the hooks, so that the straps are capable of supporting a sink;

c. placing the sink on the straps, and placing a water sealing material along the top lip of the sink;

e. installing a countertop over the underlay and sink; and f. adjusting the straps to tighten them, thereby raising the sink against the underside of the countertop, compressing the sealing material.

15. The method of claim 14, wherein positioning adjustments to the straps are made to avoid plumbing fixtures after installation of the straps.

16. The method of claim 14, wherein the sink is raised to ⅜ inch below the underlay after placing the sink on the straps.

17. The method of claim 14, wherein the straps are tightened by alternately tightening each strap.

* * * * *